US007783235B2

(12) United States Patent
Tsukamoto et al.

(10) Patent No.: US 7,783,235 B2
(45) Date of Patent: Aug. 24, 2010

(54) HOPPING TONER DEVELOPMENT APPARATUS AND IMAGE FORMATION APPARATUS

(75) Inventors: Takeo Tsukamoto, Kanagawa (JP); Nobuaki Kondoh, Kanagawa (JP); Masanori Horike, Kanagawa (JP); Tomoko Takahashi, Kanagawa (JP); Masaaki Yamada, Tokyo (JP); Hideki Kosugi, Kanagawa (JP); Ichiro Kadota, Kanagawa (JP); Yoshinori Nakagawa, Kanagawa (JP); Yasuyuki Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 285 days.

(21) Appl. No.: 11/868,698

(22) Filed: Oct. 8, 2007

(65) Prior Publication Data

US 2008/0089720 A1 Apr. 17, 2008

(30) Foreign Application Priority Data

Oct. 13, 2006 (JP) ..... 2006-279541

(51) Int. Cl.
*G03G 15/08* (2006.01)
*G03G 15/09* (2006.01)

(52) U.S. Cl. ..... 399/260; 399/266; 399/267; 399/289

(58) Field of Classification Search ..... 399/260, 399/266, 267, 270, 289
See application file for complete search history.

(56) References Cited

U.S. PATENT DOCUMENTS 5,463,452 A * 10/1995 Inaba et al. ..... 399/270
5,799,234 A 8/1998 Furuya et al.
6,345,161 B2 * 2/2002 Mizuno ..... 399/55
6,684,047 B2 * 1/2004 Kin et al. ..... 399/284
6,934,496 B2 8/2005 Sakuma et al.
2007/0242985 A1 10/2007 Aoki et al.

FOREIGN PATENT DOCUMENTS

JP 3-21967 1/1991

(Continued)

OTHER PUBLICATIONS

U.S. Appl. No. 12/261,302, filed Oct. 30, 2008, Kosugi, et al.

(Continued)

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

A development apparatus using a hopping method and an image formation apparatus including the development apparatus are disclosed. The development apparatus includes a toner supporting object for supporting and conveying a toner by a movement of the toner supporting object, while the toner is hopping on a surface of the toner supporting object by an electric field;

a regulating member made of a flexible material for constituting a toner thickness regulation position;

a latent image supporting object for supporting a latent image; and a development position, which is a position of the toner supporting object, that counters the latent image supporting object;

wherein the toner is conveyed through the regulation position to the development position where the toner is adhered to the latent image, and wherein one end of the regulating member is supported, and the other end contacts the toner supporting object.

9 Claims, 13 Drawing Sheets

FOREIGN PATENT DOCUMENTS

| | | |
|---|---|---|
| JP | 3-100575 | 4/1991 |
| JP | 3-113474 | 5/1991 |
| JP | 9-269661 | 10/1997 |
| JP | 2002-341656 | 11/2002 |
| JP | 2003-15419 | 1/2003 |
| JP | 2003-84560 | 3/2003 |
| JP | 2004-286837 | 10/2004 |

OTHER PUBLICATIONS

U.S. Appl. No. 12/176,054, filed Jul. 18, 2008, Kadota, et al.
U.S. Appl. No. 11/868,735, filed Oct. 8, 2007, Tsukamoto, et al.
U.S. Appl. No. 12/209,812, filed Sep. 12, 2008, Aoki, et al.

* cited by examiner

HOPPING TONER DEVELOPMENT APPARATUS AND IMAGE FORMATION APPARATUS

BACKGROUND OF THE INVENTION

1. Field of the Invention

The present invention relates to a development apparatus, and an image formation apparatus such as a copying machine, a printer, and a facsimile apparatus that forms an image using the development apparatus.

2. Description of the Related Art

Conventionally, a development apparatus that develops an image with toner that hops on a surface of a toner supporting object, such as a toner conveyance substrate, is known wherein toner adsorbed by a developing roller or a magnetic carrier is not used.

For example, Patent Reference 1 discloses a development apparatus that includes a cylindrical toner supporting object that includes two or more electrodes arranged at a predetermined pitch in a circumferential direction. There, two adjacent electrodes constitute a pair, and electrode pairs are repeatedly arranged. Between two electrodes of an electrode pair, an alternating current (AC) electric field is formed. Then, the toner on one electrode of the pair is floated (hops) and lands on the other electrode, and vice versa. With a rotational drive of the cylindrical toner supporting object, the toner, which repeats hopping, is conveyed to a development position. At the development position, the toner that hops to the vicinity of a latent image on a latent image supporting object is pulled to the latent image by the electric field, and adheres to the latent image without descending toward the electrode of the toner supporting object. With this configuration, the toner that is hopping is used instead of the toner that is adsorbed by the developing roller, the magnetic carrier, etc. In this way, a low voltage development that cannot be realized with a conventional 1-component development method or a 2-component development method is realized. For example, the toner can be selectively adhered at a low voltage such as dozens V between an image part and a non-image part.

[Patent Reference 1] JPA H3-21967

[Disclosure of Invention]

[Objective of Invention]

According to the development apparatus disclosed by Patent Reference 1, by rotationally driving the toner supporting object, the toner that is supported on the surface of the cylindrical toner supporting object is conveyed to a position where a roller made from urethane foam is contacted so that the thickness of the toner on the surface of the toner supporting object may be regulated. However, since the roller made from the urethane foam is easily deformed when contacting an object, it is difficult to make the thickness of the toner uniform on the surface of the toner supporting object. Further, since the central section in an axial direction of the toner supporting object that is not supported by a bearing tends to sag, the thickness of the toner tends to be greater at the central section in a direction perpendicular to a surface moving direction of the surface of the toner supporting object than both ends. For this reason, according to the development apparatus of Patent Reference 1, the toner thickness tends to be uneven, and, therefore, development concentration tends to be uneven.

SUMMARY OF THE INVENTION

The present invention provides a development apparatus and an image formation apparatus that substantially obviate one or more of the problems caused by the limitations and disadvantages of the related art.

Specifically, the present invention provides a development apparatus and an image formation apparatus that employ a hopping method wherein the development consistency unevenness due to the toner thickness unevenness is reduced.

Features of embodiments of the present invention are set forth in the description that follows, and in part will become apparent from the description and the accompanying drawings, or may be learned by practice of the invention according to the teachings provided in the description. Problem solutions provided by an embodiment of the present invention may be realized and attained by a development apparatus and an image formation apparatus particularly pointed out in the specification in such full, clear, concise, and exact terms as to enable a person having ordinary skill in the art to practice the invention.

[Means for Solving Problem]

To achieve these solutions and in accordance with an aspect of the invention, as embodied and broadly described herein, an embodiment of the invention provides a development apparatus and an image formation apparatus as follows.

An aspect of the embodiment provides a development apparatus, wherein toner supported on the surface of a toner supporting object hops on the surface by an electric field and moves with a movement of the surface to a position that counters a latent image supporting object so that the toner is transferred to a latent image formed on the latent image supporting object after the toner is passed through a toner thickness regulation position constituted by a regulating member. There, the regulating member is made of a flexible material, one end of which regulating member is supported, and the other end (free end) of which regulating member contacts the toner supporting object.

According to another aspect of the embodiment, in the development apparatus, the surface of the toner supporting object is endlessly moving, and the electric field is formed all over the circumference of the surface in the endless moving direction.

According to another aspect of the embodiment, in the development apparatus, the flexible material for the regulating object contains a material that promotes friction electrification on to the regular electrification polarity side of the toner when the flexible material comes into sliding contact with the toner on the surface of the toner supporting object.

According to another aspect of the embodiment, in the development apparatus, a main component of the toner is one of polyester and styrene acrylics, and the flexible material is made from one or a combination of silicone resin, nylon resin, melamine resin, acrylic resin, poly vinyl alcohol (PVA), urethane, quaternary ammonium salt, and a nigrosine system dye.

According to another aspect of the embodiment, in the development apparatus, the flexible material is made of a conductive material.

Another aspect of the embodiment provides an image formation apparatus that includes the development apparatus as described above for superposing two or more toner images on the latent image supporting object.

[Effectiveness of Invention]

According to the embodiment of the present invention, it is possible to support all the areas of the supporting end of the flexible member serving as the regulating member by a supporting member in the direction perpendicular to the surface moving direction of the toner supporting object. For this reason, compared with the case wherein a roller is supported only at end areas by bearings, bending (sag) at the central position can be reduced. Further, the flexible material can be a member, such as a blade, that does not produce an elastic deformation in thickness directions. As a result, the toner thickness unevenness due to elastic deformation in the thickness directions of the regulating member, and the toner thickness unevenness due to bending of the regulating member in the axial direction are reduced compared with the case wherein the roller made from urethane foam is used as the regulating member. Accordingly, the uneven development consistency due to the uneven toner thickness on the surface of the toner supporting object can be reduced compared with the conventional configuration.

DESCRIPTION OF THE PREFERRED EMBODIMENTS

In the following, embodiments of the present invention are described with reference to the accompanying drawings.

Figure 1:
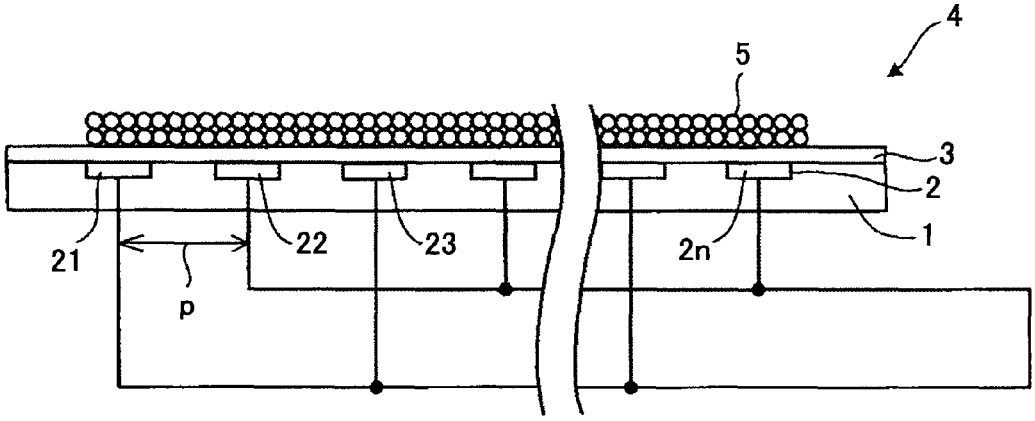
FIG. 1 is a cross-sectional drawing of a system used in an experiment about the present invention.

First, experiments conducted by the Inventors hereto concerning the present invention are described. With reference to FIG. 1, a substrate 4 serving as a toner supporting object was manufactured by first carrying out a vacuum evaporation of aluminum on a glass substrate 1 so that an electrode pattern 2 was formed, wherein two or more electrodes 21, 22, and 23 were arranged at a pitch of p μm in a moving direction. Then, a protection layer 3 was formed on the electrode pattern 2. The protection layer 3 was a resin coat of about 3 μm thickness and a volume specific resistance of about $10^{10}$ Ω-cm. On the substrate (toner supporting object) 4, a toner layer 5 that was electrified was formed.

Figure 2:
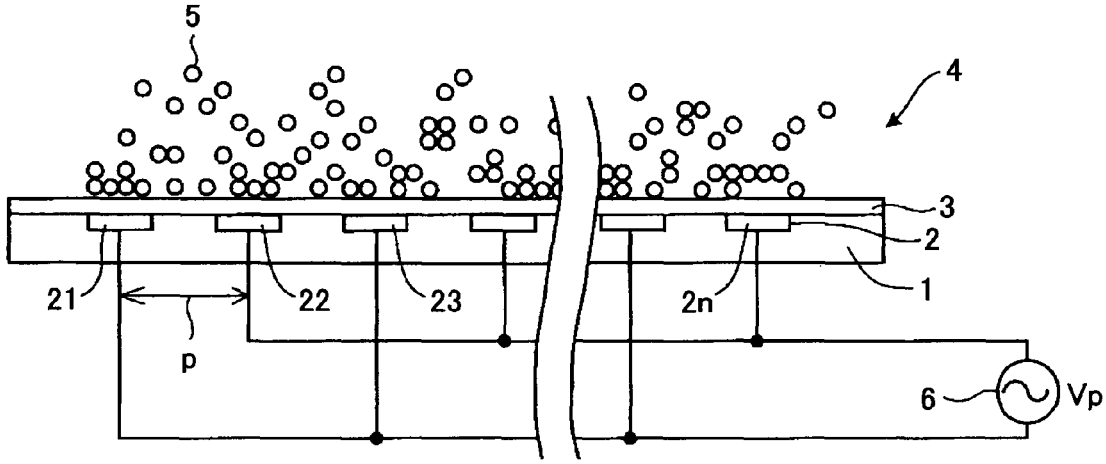
FIG. 2 is a cross-sectional drawing showing a flare state of the experimental system.

The toner layer 5 was formed on the substrate 4 by developing a solid black image with a 2-component development apparatus that is not illustrated. The toner was of a polyester system, and has a particle diameter of about 6 μm. The amount of electrification of the toner formed into a thin film on the substrate 4 was about −22 μC/g. Then, an AC voltage was applied to the electrodes as shown in FIG. 2. Specifically, to odd-numbered electrodes 21, 23, and so on, the AC voltage in one phase was provided from an AC power supply 6; and to even-numbered electrodes 22, and so on, the AC voltage in the inverse phase was provided. Then, particles of the toner 5 moved from the odd-numbered electrodes to the even-numbered electrodes, and vice versa. This phenomenon is hereafter called flare (or flare phenomenon). Further, where the flare phenomenon is present is called a flare state.

Figure 3:
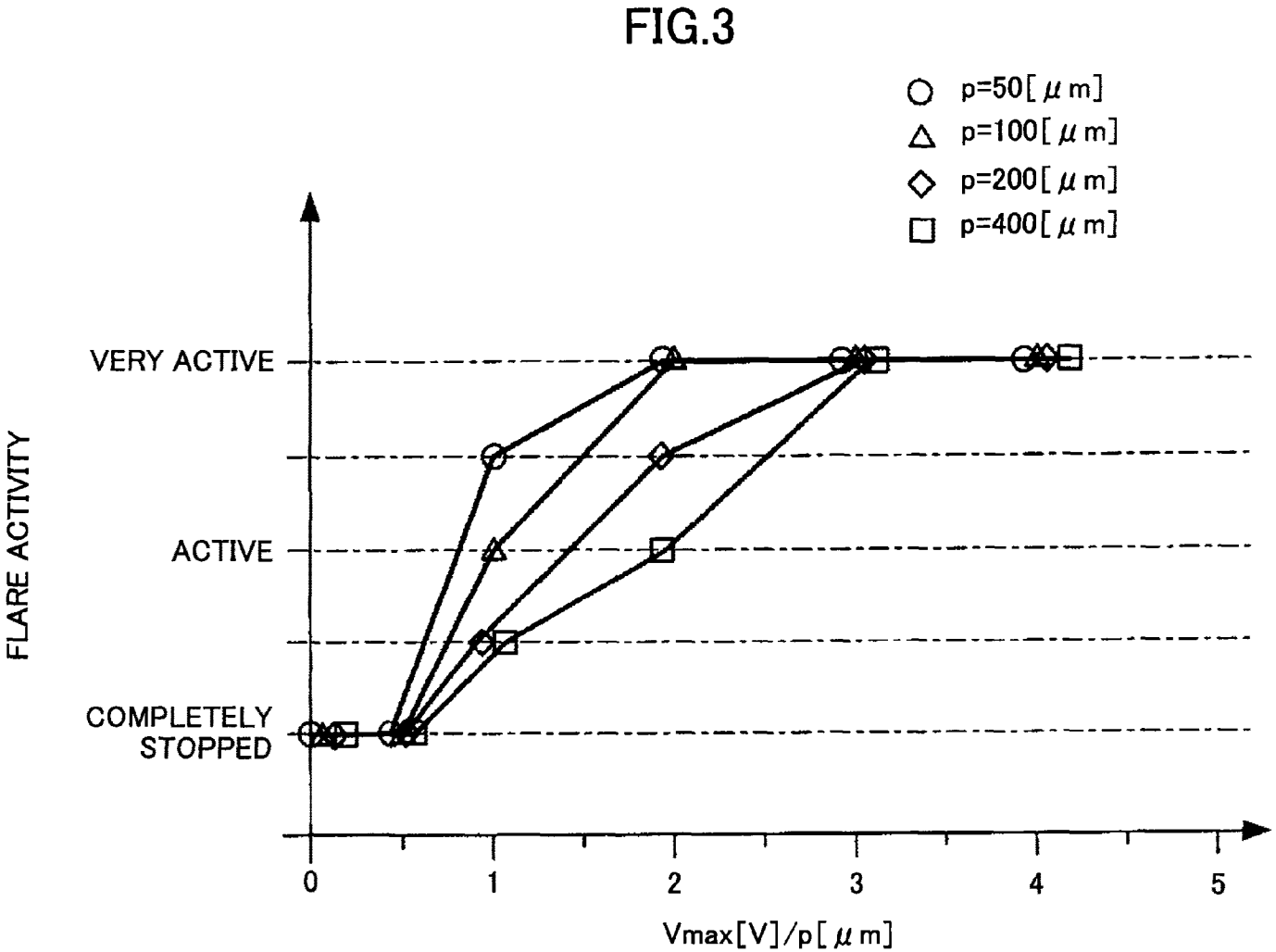
FIG. 3 is a graph showing relationships between a degree of flare activity and Vmax V/p μm obtained as a result of the experiment.

Four samples of the substrate 4 were manufactured, wherein the electrode pitch p between the electrodes 21, 22, 23, and so on was differentiated, namely, p=50, 100, 200, and 400 μm. Then, the degree of flare activity was observed with a high-speed camera, changing Vmax V that is a voltage difference between a positive peak and a negative peak of the voltage of the AC voltage applied to the electrodes 21, 22, 23, and so on from the AC power supply 6. Results are obtained as shown in FIG. 3. Here, the width of the electrodes 21, 22, 23, and so on, and a distance from the electrodes 21, 22, 23, and so on to the respective adjacent electrodes was equal to one half of the electrode pitch p of the electrodes 21, 22, 23, and so on.

Here, the degree of flare activity was obtained by a sensory evaluation wherein a situation of the toner not moving but sticking to the surface of the substrate 4 was evaluated in 5 levels. As shown in FIG. 3, the degree of flare activity was almost unambiguously determined by a ratio of Vmax V/p μm regardless of values of Vmax and p. As shown in FIG. 3, the flare began to be active at Vmax V/p μm=1, and was completely activated at Vmax V/p μm>=3.

Figure 4:
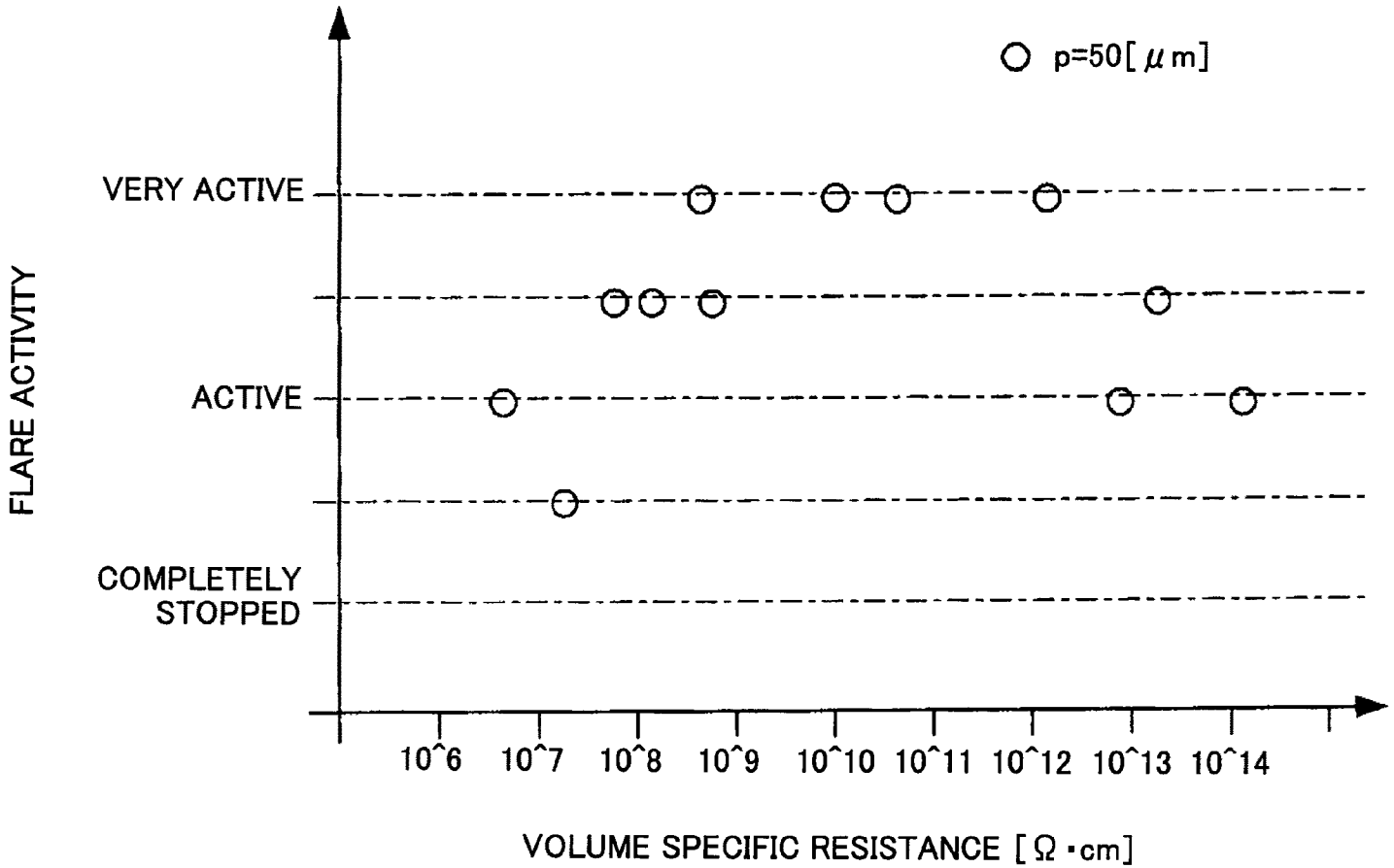
FIG. 4 is a plot diagram showing relationships between the degree of flare activity and volume specific resistance of a surface layer 3 as a result of the experiment.

Further, in order to determine an influence of an electrical property of the surface of the substrate 4, a volume specific resistance of the surface layer 3 of the substrate 4 was changed, and the degree of the flare activity was similarly evaluated. The material of the surface layer 3 was a silicone system resin, and the amount of carbon particles contained in the silicone system resin was changed so that the surface layer 3 (thickness of which surface layer 3 is about 5 μm) has a volume specific resistance between $10^7$ and $10^{14}$ Ω-cm. As a typical example, the electrode pitch was 50 μm. Then, experiment results were obtained as shown in FIG. 4.

Figure 11:
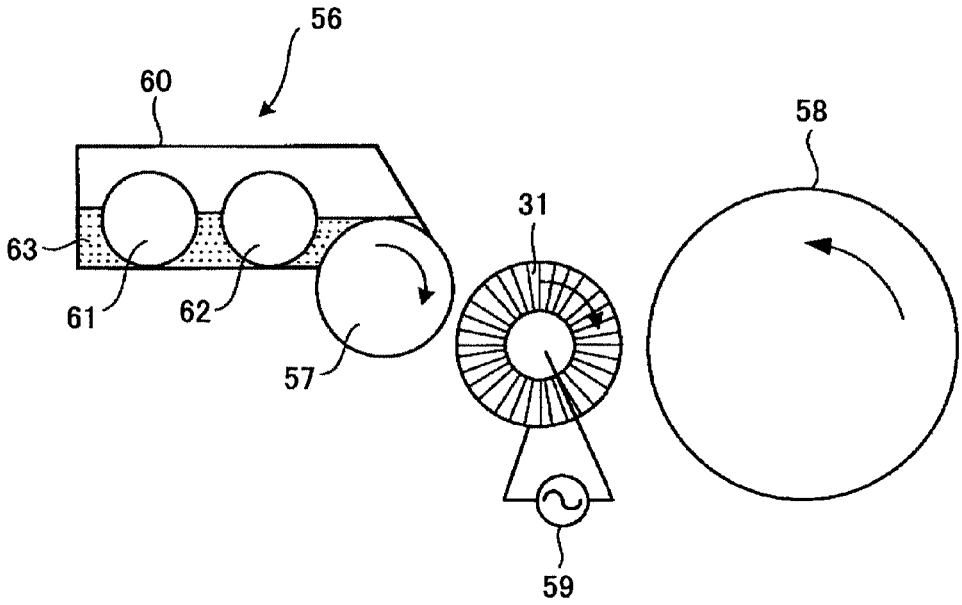
FIG. 11 is a schematic drawing showing an outline of an image formation apparatus wherein development is carried out by hopping using a 2-component developer containing a toner and a magnetic carrier.

From the experiment results, it was determined that an appropriate volume specific resistance of the surface layer 3 ranged between $10^9$ and $10^{12}$ Ω-cm. Otherwise, if the volume specific resistance of the surface layer 3 was too high, the surface of the substrate 4 remained being charged by friction of the surface layer 3 and the toner that repeated hopping. The charge causes the surface voltage of the substrate 4 to fluctuate, and a bias voltage for development became unstable. To the contrary, if the conductivity of the surface layer 3 was too high, a charge leak (short circuit) occurred between the electrodes 21, 22, 23, and so on, and the bias voltage was degraded. That is, the specific resistance of the surface layer 3 had to be appropriate (i.e., between $10^9$ and $10^{12}$ Ω-cm) such that the charge accumulated on the surface layer 3 on the substrate 4 could be properly discharged to the electrodes 21, 22, 23, and so on. In addition, the range of the volume specific resistance was determined through experiments using the experimental system shown in FIG. 2. In the case of a development apparatus that includes a developing roller (described below) as shown in FIG. 11, the optimal range may be different, and a suitable range of the volume specific resistance is to be determined through experiments.

The inventors hereto further conducted an observation of the degree of flare activity with two kinds of the surface layer 3; namely, one was made of silicone system resin and the other was made of fluorine system resin. This was to determine the influence of a friction electrification characteristic of the surface of the substrate 4. The volume specific resistance of the surface layer 3 of both the silicone system resin and the fluorine system resin was made to be $10^{11}$-$10^{12}$ Ω-cm by distributing a small quantity of carbon particles. Then, the degree of flare activity was observed by applying an AC bias to the electrodes 21, 22, 23, and so on from the AC power supply 6. With the surface layer 3 of the silicone system resin, the flare state was maintained for a long time. With the surface layer 3 of the fluorine system resin, the flare quickly disappeared and the toner stuck to the substrate 4.

After the observation, an amount of electrification of the toner on the substrate 4 was measured. With the surface layer 3 of the silicone system resin, the amount of electrification of the toner on the substrate 4 was a little smaller than an initial stage. With the surface layer 3 of the fluorine system resin, the amount of electrification of the toner on the substrate 4 was almost lost. Next, toner that was not charged was rubbed onto the surface layer 3. In the case of the surface layer 3 of the silicone system resin, the toner acquired a positive polarity charge. In the case of the surface layer 3 of the fluorine system resin, the toner acquired almost no charge, or a slight negative polarity charge. Given that the flare phenomenon is a process wherein the toner collides with the surface of the substrate 4 for a great number of times, the surface layer 3 is desirably made of a material that gives a positive polarity charge to the toner, rather than a material that discharges the toner. That is, a friction electrification series of materials can be referenced, and the surface layer 3 is desirably made of, e.g., a glass system, and a material used in a carrier coat of 2-component developer.

Figure 5:
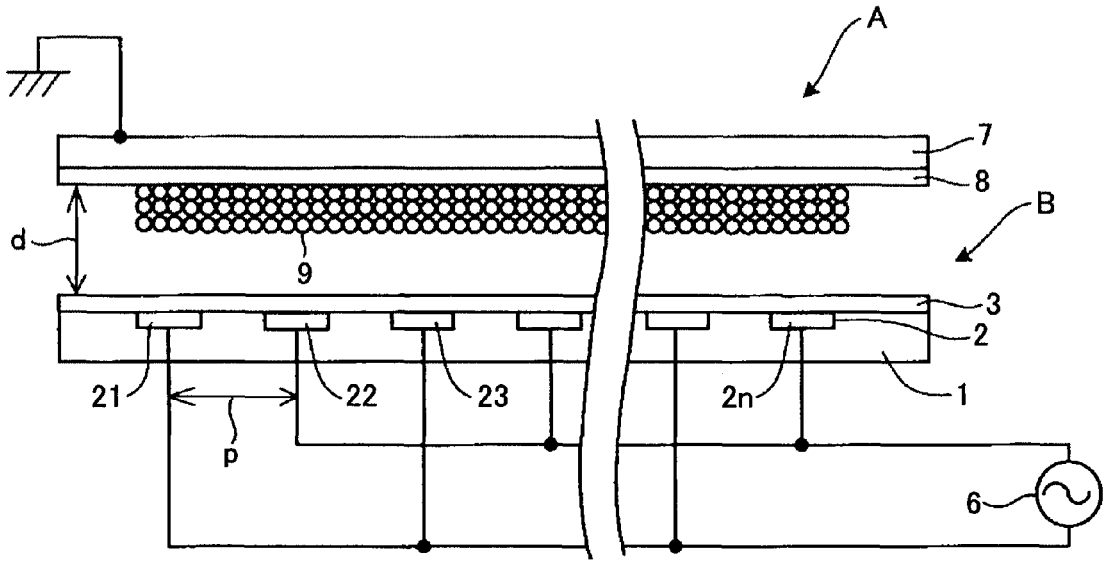
FIG. 5 is a cross-sectional drawing of another system used in the experiment about the present invention.

Next, experiment results of another system as shown in FIG. 5 are described. This system includes a substrate A that is formed by a resin layer 8 (assumed as a photo conductor) on a substrate 7 made of aluminum. The resin layer 8 is about 20 μm thick. The substrate 7 is grounded. A toner layer 9 of 0.4 mg/cm$^2$ equivalent to a solid black image is formed on the resin layer 8. The toner layer 9 is formed by developing the solid black image on the resin layer 8 with a 2-component development apparatus that is not illustrated.

Figure 6:
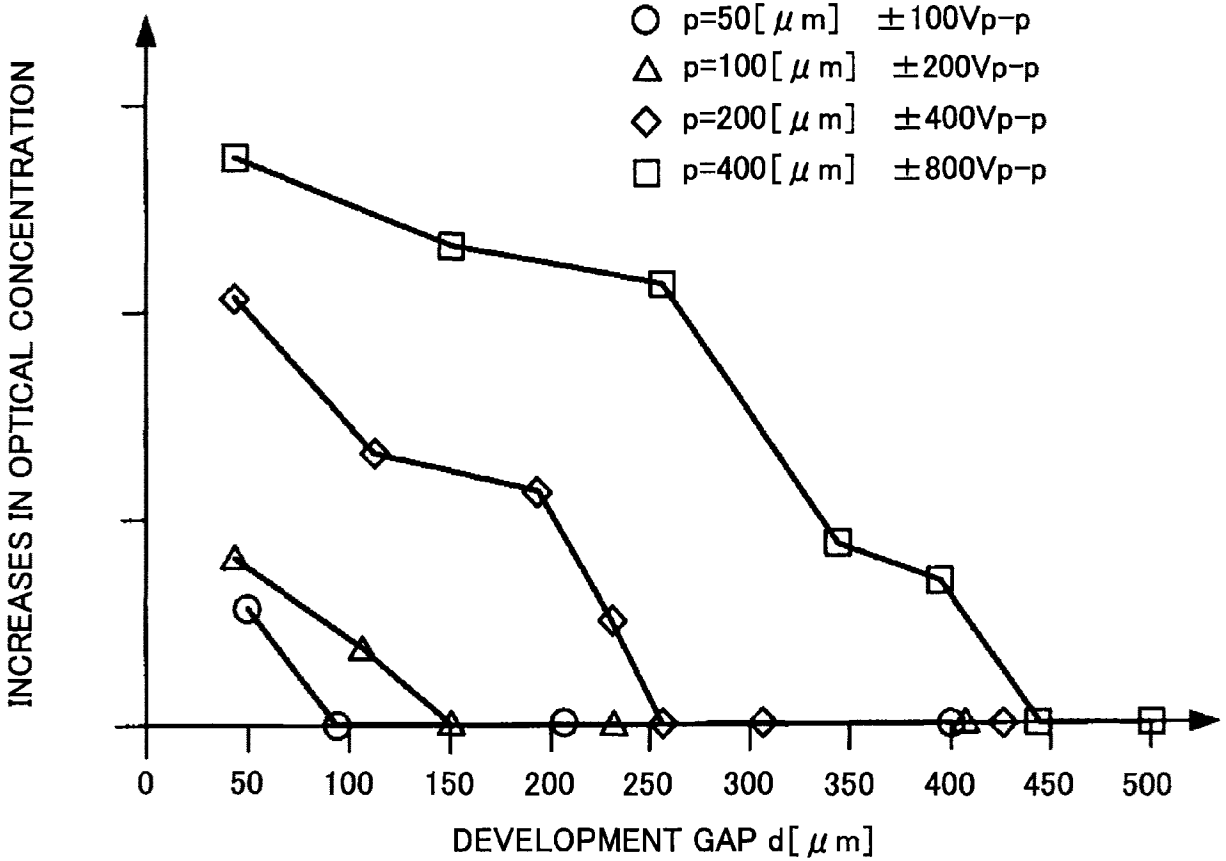
FIG. 6 is a graph showing relationships between development gaps and increases in optical concentration on a substrate A as a result of the experiment.

The system further includes a substrate B that is installed countering the substrate A at a gap d μm. The substrate B is constituted like the substrate 4. The surface layer 3 is made into a white coat layer so that measurement with an optical measurement instrument (a catoptrical light consistency measuring instrument) of an amount of toner to be transferred here by subsequent work is facilitated. Then, dependability of an amount of toner transition to the substrate B to the development gap d μm was investigated, wherein four combinations of Vmax V and p μm were used, all of which combinations give Vmax V/p μm=4. Note that the flare was stably formed where Vmax V/p μm is equal to 4 regardless of other conditions as shown in FIG. 3. Results obtained are shown in FIG. 6. The vertical axis of FIG. 6 represents an amount of increase in optical concentration of the surface layer 3 of the substrate B. The horizontal axis of FIG. 6 represents the development gap d μm. Where no toner is adhered to the surface layer 3, the amount of increase in optical concentration is 0. In FIG. 6, there are results wherein the amount of increase in optical concentration is greater rather than 0; this is because some toner of the toner layer 9 adhering to the resin layer 8 of the substrate A was transferred to the surface layer 3 of the substrate B from the toner layer 9 by the influence of the electric field formed on the substrate B. If such transfer occurs in superposition development, toner formed on a latent image supporting object (for example, a photo conductor) for a preceding development is transferred to the development apparatus of a following color at the time of the following development, that is, colors are mixed. Further, an image obtained on the latent image supporting object in the preceding development is disturbed. Accordingly, when the amount of increase in optical concentration is 0, the color mixture and the image disturbance can be avoided. It is determined from FIG. 6 that if the pitch distance p is smaller than the development gap d (p<d), the color mixture and the image disturbance can be avoided.

This can be taken as a condition under which influences of an electric field curtain formed on the toner supporting object (substrate B) do not reach the electrostatic latent image electric field or the toner image on the latent image supporting object (substrate A). Under this condition, not only an isolated dot can be correctly developed at, for example, 1200 dpi and 2400 dpi without scavenging, but also a very high definition toner image superposition can be realized without causing the color mixture of the toner in the development apparatus, and without disturbing the toner image previously formed on the latent image supporting object when forming an image by an image forming process like the toner image superposition on the latent image supporting object (substrate A) as described above.

By the way, conventional development apparatuses used by image formation apparatuses, such as a copying machine, a printer, and a facsimile apparatus, often employ one of a 2-component development method, and a 1-component development method. The 2-component development method is suitable for high-speed development, and currently is a mainstream method for a medium to high-speed image formation apparatus. According to the 2-component development method, in order to obtain high definition, the developer at a position contacting the electrostatic latent image on the latent image supporting object has to be very minute. For this purpose, miniaturization of the diameter of carrier particles is progressing, and a particle diameter of about 30 μm is commercially available.

The 1-component development method, which requires a small and lightweight mechanism, is a mainstream of a low speed image formation apparatus at present. According to the 1-component development method, the toner supported on the surface of a developer supporting object, such as a developing roller, is used for development without hopping. Specifically, in order to form a thin toner layer on the developing roller, a toner regulating member, such as a blade and a roller, is made to contact the toner on the developing roller, and the toner is then electrified by friction with the developing roller and the toner regulating member. The electrified thin toner layer formed on the developing roller is carried to the development position, and the electrostatic latent image on the latent image supporting object is developed. Here, the 1-component development method can be classified into two types.

One is a contacting type, and the other is a non-contacting type. As for the former, the developing roller and the latent image supporting object make contact; and as for the latter, the developing roller and latent image supporting object do not make contact.

For example, JPA H3-100575 discloses a hybrid method wherein the 2-component development method and the 1-component development method are combined such that shortcomings of one are complemented by the other.

For example, JPA H3-113474 discloses a method of developing a minute uniform dot of a high resolution. According to the method, a wire, to which a high frequency bias is applied, is provided to the development unit that is based on the hybrid method as described above so that a toner cloud is obtained in the development unit. In this way, a high resolution dot can be developed.

Further, JPA H3-21967 (Patent Reference 1) discloses a method of efficiently and stably forming the toner cloud, wherein an electric-field curtain is formed on a rotation roller.

Further, JPA 2003-15419 discloses a development apparatus wherein a developer is conveyed by an electric-field curtain by a progressive-wave electric field. Further, JPA H9-269661 discloses a development apparatus that includes two or more magnetic poles for almost uniformly adsorbing a carrier of about one layer on the circumference of a developing roller. Further, JPA 2003-84560 discloses a development apparatus wherein a periodic conductive electrode pattern is formed on a developer supporting body for supporting a non-magnetic toner through an insulation member, and an electric-field gradient is generated near the developer supporting body surface by providing a predetermined bias voltage to the electrode so that a non-magnetic toner is adhered to the developer supporting object and conveyed by the developer supporting object.

It is increasingly required that the conventional 2-component development provide high-definition capability. It is required that the dot size of a pixel be equivalent to or even smaller than the present diameter of the carrier particles. From the viewpoint of reproducibility of an isolated dot, the diameter of the carrier particles should be smaller than now. However, the smaller is the diameter, the smaller becomes the permeability of the carrier particles. Small particle carrier tends to be disassociated from a developing roller. If the disassociated carrier particles are adhered to a latent image supporting object, various side effects can occur such as damaging the latent image supporting object in addition to producing a faulty image.

In order to prevent the carrier from disassociating, attempts have been made, e.g., by raising the permeability of the carrier particles by selecting an appropriate material, and by strengthening the magnetism of a magnet included in the developing roller. However, development works have reached an extreme of difficulty in balance between the cost and high definition. Further, requirements for miniaturization of an apparatus lead to reduction of the diameter of the developing roller, which makes it further difficult to design a developing roller with a powerful magnetic field for preventing the carrier disassociation.

First of all, since the 2-component development method is a process of forming a toner image by an ear, called a magnetic brush, of a 2-component developer rubbing an electrostatic latent image, unevenness tends to be produced when developing an isolated dot due to the heterogeneity of the ear. Even though an improvement in quality of the image is possible by forming an alternating current (AC) electric field between the developing roller and the latent image supporting object, it is difficult to completely remove the unevenness of the image due to fundamental unevenness of the ear of the developer.

Further, in order to raise transfer efficiency of a process of transferring the toner image developed on the latent image supporting object, and in order to raise cleaning efficiency of a process of cleaning the toner that remains on the latent image supporting object after transfer, non-electrostatic adhesion of the toner to the latent image supporting object has to be reduced as much as possible. As a method of reducing the non-electrostatic adhesion of the toner to the latent image supporting object, a friction coefficient of the surface of the latent image supporting body may be reduced. However, if the friction coefficient is small, the ear of the 2-component developer may smoothly pass through the development position, which causes the development efficiency and dot reproducibility to be degraded.

According to the 1-component development method, the toner layer on the developing roller is fully press-contacted to the toner regulating member; for this reason, toner response to the electric field at the development position is poor. Accordingly, it is a usual practice to form a powerful alternating current (AC) electric field between the developing roller and the latent image supporting object in order to obtain high definition. However, even if the AC electric field is formed, it is difficult to stably develop the toner at a constant rate for the electrostatic latent image, and it is difficult to uniformly develop the minute dot of a high resolution. Further, according to the 1-component development method, a great stress is applied to the toner when the toner is formed in lamination on the developing roller, which causes the toner, which is recycled in the development apparatus, to be quickly degraded. With the degradation of the toner, the toner tends to be uneven. For this reason, the 1-component development method is not generally suitable for a high speed/high durability image formation apparatus.

According to the hybrid method (JPA H3-100575), although the size and the number of components of the development apparatus are increased, some problems are overcome. Nevertheless, the same problem as the 1-component development method remains at the development position, that is, it is difficult to develop a minute and uniform dot in high resolution.

Although high stability and high definition development may be realized by the method disclosed by JPA H3-113474, the configuration of the development apparatus becomes complicated.

Further, the method disclosed by JPA H3-21967 (Patent Reference 1) may be excellent in obtaining small and high-definition development; however, the Inventors hereto have discovered that, in order to obtain the ideal high definition, conditions concerning such as electric-field curtain forming and development are restrictive. In other words, unless image formation is carried out under the restrictive conditions, merits of the method cannot be enjoyed at all; not only that, the image quality is degraded. Further, according to this method, the toner is conveyed while hopping on the toner supporting object to a development position by a movement of the toner supporting object; however, this problem (limited conditions) is common to the method disclosed by JPA 2002-341656, wherein the toner is conveyed to the development position only by a hopping movement, not by a movement of the toner supporting object.

Further, for an image formation process wherein a first toner image is formed on the latent image supporting object, then a second toner image, then a third toner image, and so on, one by one, the development method has to be such that the toner image(s) already formed on the latent image supporting object is not disturbed. According to the non-contacting 1-component development method and the toner cloud development method disclosed by JPA H3-113474, it is possible to form color toner images one by one on the latent image supporting object. However, since an alternating current (AC) electric field is formed between the latent image supporting object and the developing roller, a part of the toner tends to be torn off from the toner image already formed on the latent image supporting object, and the torn-off toner enters the development apparatus. That is, the image on the latent image supporting object is disturbed by this, and further a problem is posed that the toner in the development apparatus is mixed with another color. This is a vital problem for acquiring a high-definition image. A method of generating a toner cloud, wherein no alternating current (AC) electric field is formed between the latent image supporting object and the developing roller, is required.

The toner cloud may be generated by the methods disclosed by JPA H3-21967 (Patent Reference 1), and JPA 2002-341656 described above; however, merits of the methods cannot be enjoyed unless strict conditions are met as described above; otherwise, they are completely ineffective. If the conditions are not appropriate, the toner cloud cannot be generated. Even if the toner cloud is generated, a part of the toner in the toner layer on the latent image supporting object is mixed into the development apparatus of the next color, causing image disturbance and color mixture.

Then, according to the image formation apparatus of the embodiment, the condition of Vmax V/p μm>1 is sufficed in view of the result of the experiment described above. The toner cloud can be surely generated with this configuration. Therefore, according to the embodiment, higher definition and smaller size are realized compared with the conventional techniques.

In addition, it is conceivable that the toner cloud is surely generated by the method disclosed by JPA 2002-341656, wherein the toner is electrostatically moved by an AC electric field of three or more phases, not by a mechanical movement of the toner supporting object, if the condition as described above is sufficed. However, according to the method, the toner may deposit on a conveyance substrate triggered by a toner that is not electrostatically conveyed by some chances, and as a result, operations stop. In order to solve this problem, JPA 2004-286837 proposes a structure having a combination of a fixed conveyance plate and a toner supporting object that moves on the surface of the fixed conveyance plate; nevertheless, this makes the mechanism highly complicated. Conversely, according to the image formation apparatus of the embodiment of the present invention, wherein the toner is conveyed to the development position by movement of the surface of the toner supporting object, which toner moves to and fro between the electrodes by hopping, the toner is not accumulated, and the mechanism is not complicated.

Figure 7:
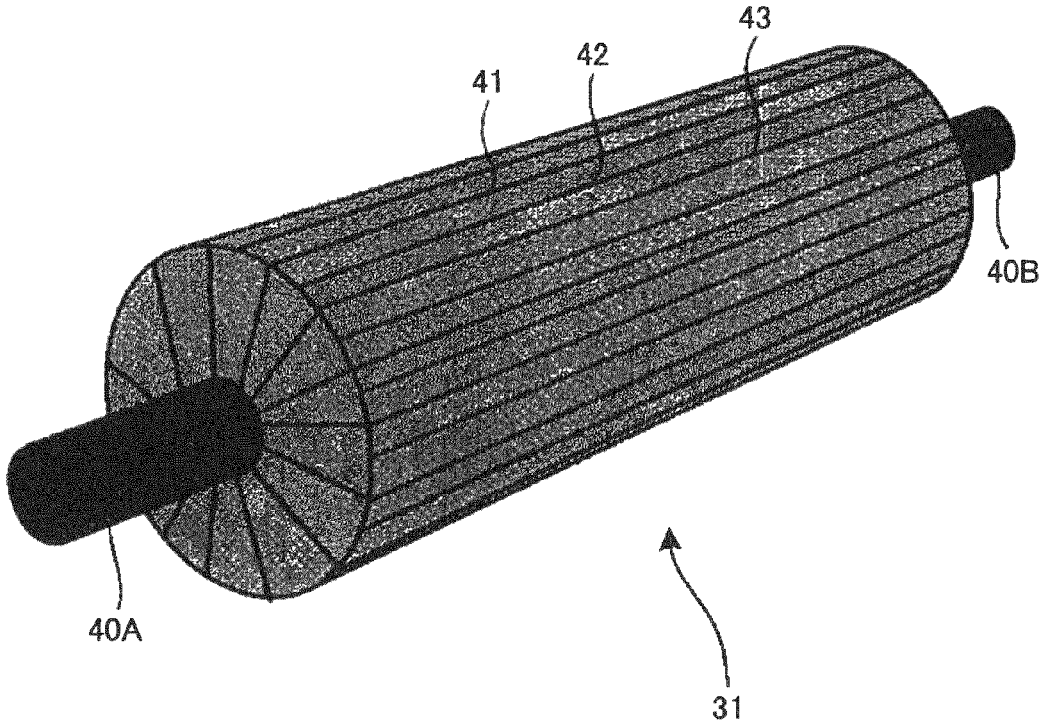
FIG. 7 is a perspective diagram of an example of a toner supporting object according to the embodiment of the present invention.
Figure 15:
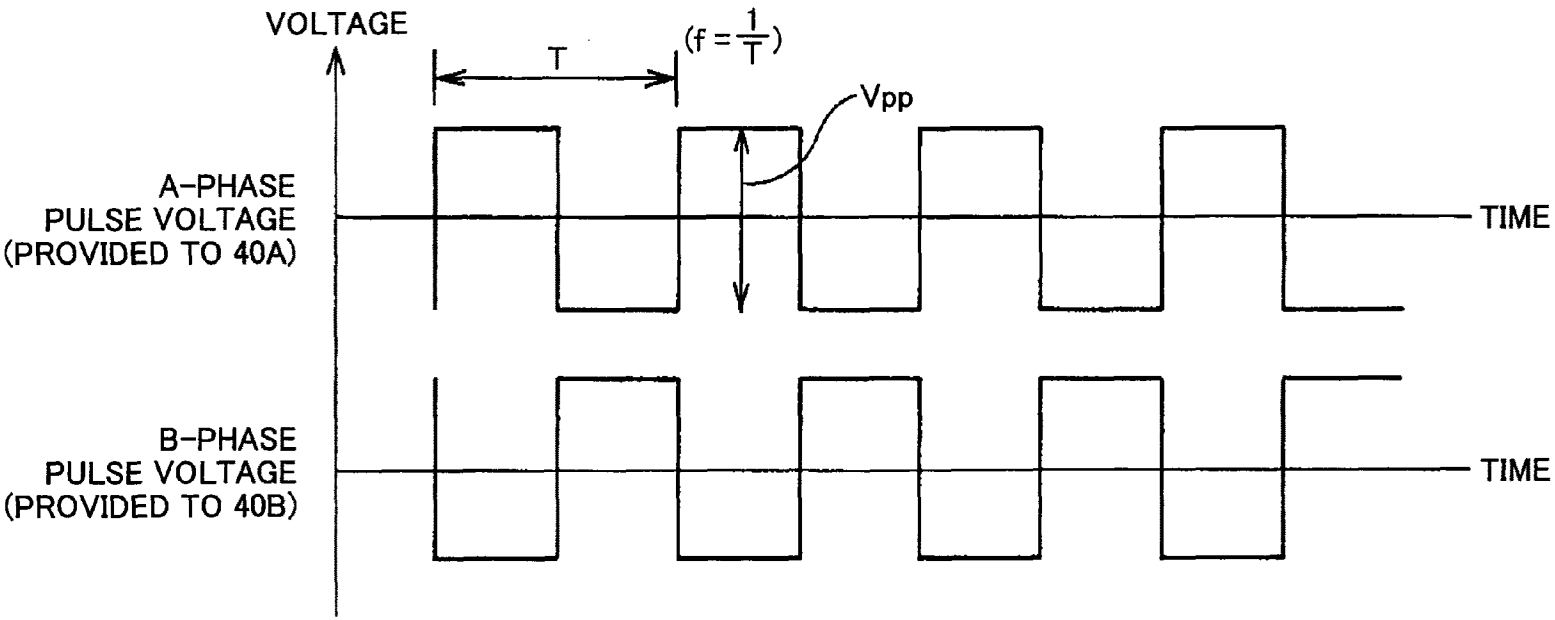
FIG. 15 is a waveform chart of an A-phase pulse voltage and a B-phase pulse voltage applied to an electrode of the toner supporting object.
Figure 16:
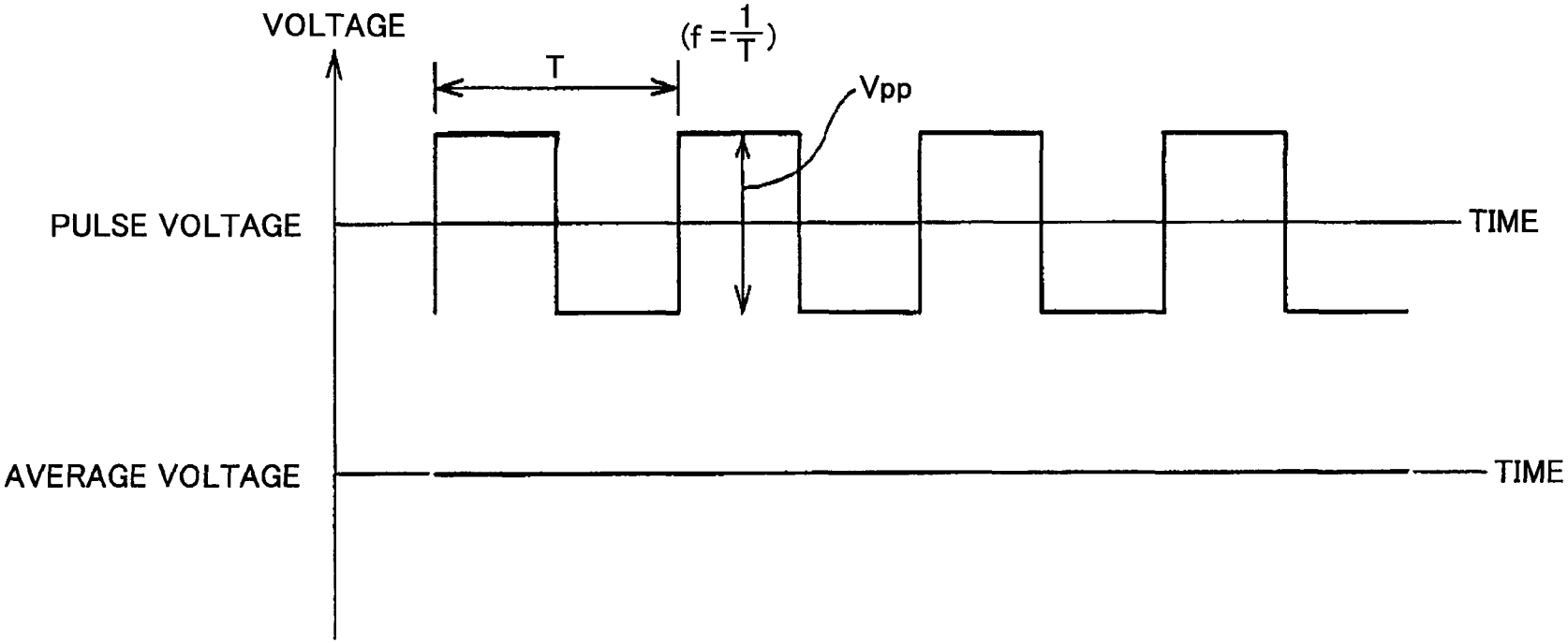
FIG. 16 is a waveform chart showing a pulse voltage applied to an electrode of a toner supporting object according to Patent Reference 1.

FIG. 7 is a perspective diagram of a typical example of a toner supporting object 31 for the image formation apparatus according to the embodiment of the present invention. The toner supporting object 31 is formed in the shape of a rotating roller, and includes an electrode pattern that is constituted by two or more electrodes 41, 42, 43, and so on that are spatially periodically arranged at a pitch of p μm in the rotational direction. There, odd-numbered electrodes are grouped to constitute an electrode shaft 40A, and even-numbered electrodes are grouped to constitute an electrode shaft 40B. The toner supporting object 31 can be rotated with the electrode shafts 40A and 40B serving as a rotation shaft. An AC voltage is provided to each of the electrode shafts 40A and 40B as a bias voltage from an AC power source (not illustrated) through an electrode brush (not illustrated). As shown in FIG. 15, the AC voltage includes a rectangular pulse A (A-phase pulse) that is provided to the electrode shaft 40A that bundles the odd-numbered electrodes, and a rectangular pulse B (B-phase pulse) that is provided to the electrode shaft 40B that bundles the even-numbered electrodes. Voltages of the A-phase pulse and the B-phase pulse are in an inverse phase as illustrated. The A-phase pulse and the B-phase pulse have the same average voltage in a unit time. Alternatively, as shown in FIG. 16, a rectangular pulse of a frequency f may be provided to one of the electrode shafts, and a DC voltage that is the same as the average voltage is provided to the other. Either way, the flare phenomenon can take place.

Figure 9:
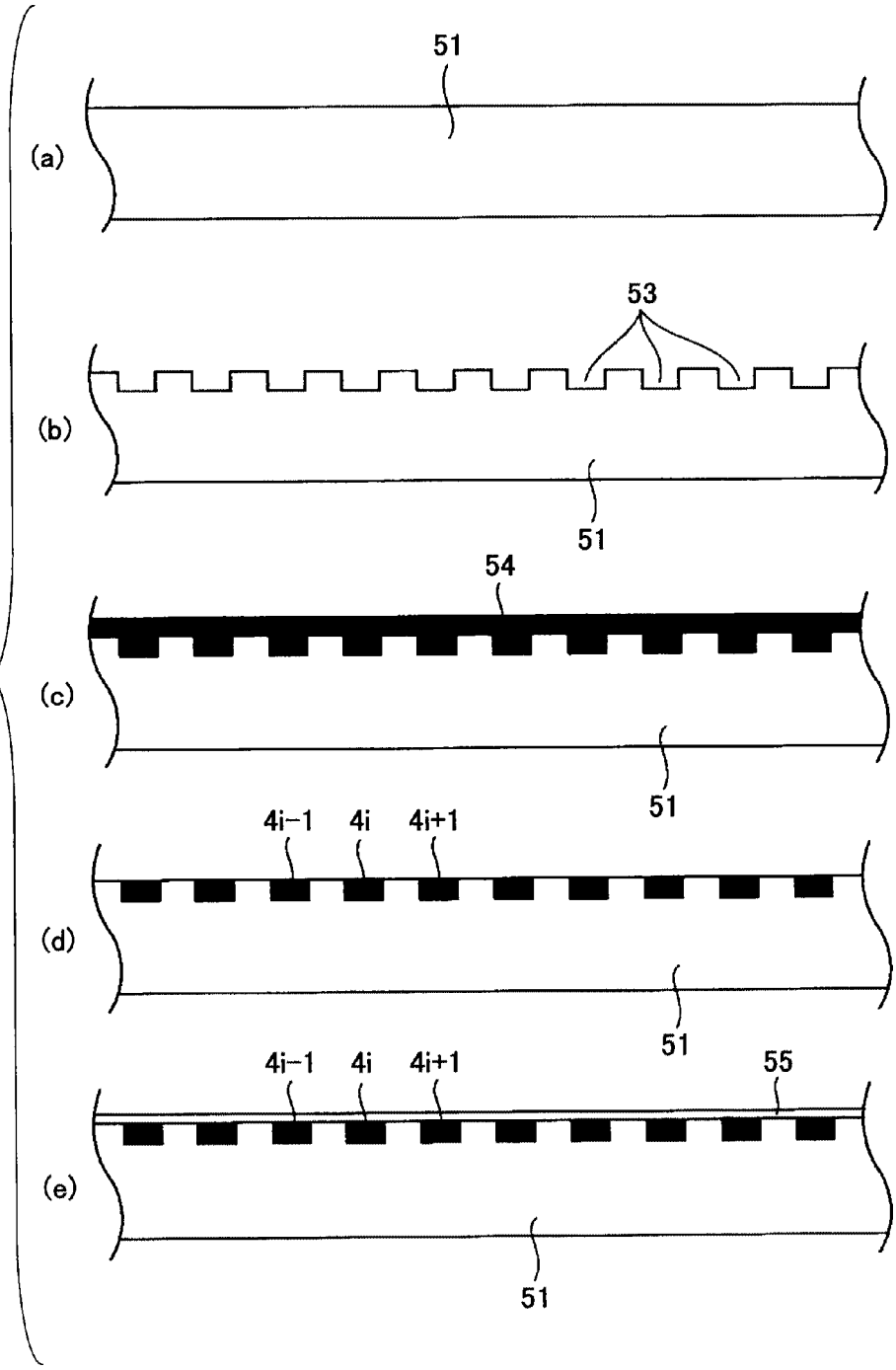
FIG. 9 is a cross-sectional drawing showing another part of the manufacturing process of the toner supporting object.
Figure 10:
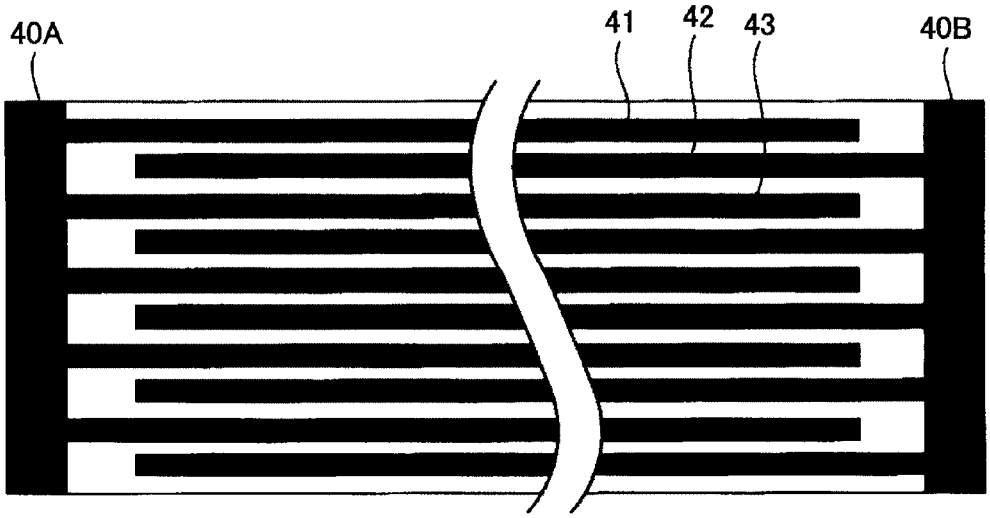
FIG. 10 is a development showing where the toner supporting object is expanded in the shape of a flat surface.

A manufacturing process of the toner supporting object 31 is described with reference to FIGS. 8, 9, and 10. The toner supporting object 31 includes a cylinder 51 made of an acrylic resin that is an insulator, and shaft holes 52 arranged to the cylinder 51 as shown at (a) of FIG. 8. Then, the electrode shafts 40A and 40B made from stainless steel are press fit into the corresponding shaft holes 52 as shown at (b) of FIG. 8. The odd-numbered electrodes 41, 43, and so on are connected to the electrode shaft 40A; and the even-numbered electrodes 42, and so on are connected to the electrode shaft 40B. Then, the electrode pattern is formed through processes shown in FIG. 9 at (a) through (e). FIG. 9 shows the surface of the toner supporting object 31 in a direction along the rotation axle. At a process shown at (a) of FIG. 9, the surface of the cylinder 51 is finished flat and smooth by perimeter lathe turning. At a process shown at (b) of FIG. 9, slots 53, each slot being 50 μm wide, are formed at a slot pitch of 100 μm. At the process shown at (c) of FIG. 9, non-electrolyzed nickel 54 is plated on the cylinder 51, to which the slots are formed. At a process shown at (d) of FIG. 9, the perimeter of the cylinder 51, on which the non-electrolyzed nickel 54 is plated, is machined so that an unnecessary conductor film may be removed, and the electrodes 4*i*−1, 4*i*, 4*i*+1, and so on may be formed in the corresponding slots 53. The electrodes 4*i*−1, 4*i*, 4*i*+1, and so on are mutually insulated. Then, the surface of the cylinder 51 is made flat and smooth by coating a silicone system resin on the cylinder 51, and at the same time, a protection layer 55 (about 5 μm thick, having a volume specific resistance about $10^{10}$ Ω-cm) is formed on the surface of the cylinder 51. The cylinder 51 manufactured in this way now serves as the toner supporting object 31. FIG. 10 is a development view of the toner supporting object 31 as expanded in the shape of a flat surface.

A thin toner layer is formed on the protection layer 55 of the toner supporting object 31, like the substrate 4. When the AC voltage, serving as a bias voltage, as shown in FIG. 15 is provided to the electrode shafts 40A and 40B from the AC power source through the electrode brush, the toner flares (moves) between the odd-numbered electrodes 41, 43, and so on and the even-numbered electrodes 42, and so on. The flare begins to be activated where Vmax V/p μm>1, and the flare is completely activated where Vmax V/p μm>3, where Vmax V is an absolute value of a difference between a positive peak of the AC voltage and a negative peak of the AC voltage provided to the electrodes 41, 42, 43, and so. Further, an appropriate volume specific resistance of the protection layer 55 of the toner supporting object 31 is in a range of $10^9$-$10^{12}$ Ω-cm, like the substrate 4; and the protection layer 55 is made of a silicone system resin. As for the material of the protection layer 55, it is desirable that the material be capable of providing a positive charge to the toner by friction with the toner as described above; for example, it is desirable to use a glass system, and a material that is used by a carrier coat of the 2-component developer. Here, p is made smaller than the development gap d, i.e., p<d.

In addition, according to the example shown in FIG. 7, the electrodes are extended to both edges of the toner supporting object 31, and connected to one of the electrode shafts 40A and 40B at the corresponding edges. According to the example shown in FIG. 10, the electrode shafts 40A and 40B are shaped like a flange, and are formed on both ends in a direction of an axle of the toner supporting object 31, wherein the electrodes are connected to one of the electrode shafts 40A and 40B.

FIG. 11 is a schematic drawing showing an outline of an image formation apparatus wherein development is carried out by hopping using a 2-component developer 63 containing a toner and a magnetic carrier. The image formation apparatus includes a development apparatus that uses the toner supporting object 31. The development apparatus includes a usual 2-component development unit 56 that provides an ear of the 2-component developer 63 by contacting the toner supporting object 31. The 2-component developer 63 is made of a magnetic carrier powder of particle diameter 50 μm and a polyester toner of particle diameter about 6 μm at 7-8 wt %. The 2-component development unit 56 includes a magnet sleeve 57 that contains a permanent magnet for conveying the 2-component developer to the toner supporting object 31. Then, a part of the toner is transferred to the toner supporting object 31 by a DC bias voltage applied between the magnet sleeve 57 and the toner supporting object 31. The toner transferred to the toner supporting object 31 forms a flare on the toner supporting object 31, is conveyed to a position that counters the latent image supporting object 58 by the toner supporting object 31 that is rotationally driven by a driving unit that is not illustrated, and develops an electrostatic latent image on the latent image supporting object 58 by adhering to the electrostatic latent image according to a difference between an average voltage of the surface of the toner supporting object 31 and a voltage of the latent image supporting object 58. A toner image is formed in this way. In addition, an AC voltage is provided between the electrode shafts 40A and 40B as a bias voltage through an electrode brush, and the like, from an AC power source 59; that is, a temporary periodic voltage difference is formed between the odd-numbered electrodes 41, 42, and so on and the even-numbered electrodes 42, and so on.

Residual toner that has not been used for the development returns from the development position to the magnet sleeve 57. Since the flare is formed, the amount of the toner that remains adhered to the toner supporting object 31 is very small. The toner that has returned from the development position by the toner supporting object 31 is easily scratched by the ear of the 2-component developer that follows the rotation of the magnet sleeve 57, and is homogenized/smoothed. By repeating this, an approximately constant amount of the toner flare is always formed on the toner supporting object 31. The 2-component development unit 56 stirs, conveys, and circulates the 2-component developer 63 in a container 60, for example, via circulation paddles 61 and 62, while the magnet sleeve 57 conveys a part of the 2-component developer 63 to the toner supporting object 31, and returns the unused toner.

In the following, described is the case wherein the latent image supporting object 58 uses an organic photo conductor that is 13 μm thick, and a latent image is formed using a laser writing unit of 1200 dpi. The latent image supporting object (photo conductor) 58 is rotationally driven by a driving unit that is not illustrated, is uniformly charged by an electrification apparatus, and is exposed by the laser writing unit such that the electrostatic latent image is formed. In this case, the electrostatic latent image is formed under conditions that an electrification voltage of the latent image supporting object (photo conductor) 58 is between −300 and −500 V, and a writing voltage for a solid image part is between 0 and −50 V.

The electrostatic latent image is developed by the toner that forms a flare on the toner supporting object 31, and turns into a toner image. At this time, conditions for producing a good single dot of 1200 dpi with the solid image part being satisfactorily printed without ground dirt for a toner made of particles 6 μm in diameter having an amount of electrification about −22 μC/g are as follows:

the gap between the toner supporting object 31 and the latent image supporting object (photo conductor) 58 is about 500 μm; and the alternating-current (AC) bias is provided from the AC power source 59 to the electrodes of the toner supporting object 31, where the AC bias peaks at −400 V and 0 V, averaging at −200 V, at a frequency of 5 kHz. Further, the phase angle of the AC bias provided to the odd-numbered electrodes is the inverse of the AC bias provided to the even-numbered electrodes.

The toner image on the toner supporting object 31 is transferred by a transferring unit to a recording medium such as paper fed by a feeding unit, and is fixed to the recording medium by a fixing unit. Then, the recording medium is discharged outside.

If an excessive amount of toner is provided to the toner supporting object 31, the electric-field curtain is shielded by the charge of the toner, which makes it impossible to form the flare. In this view, a direct-current (DC) bias of about 200 V is provided between the magnet sleeve 57 and the toner supporting object 31 from a power source so that the amount of toner on the toner supporting object 31 is 0.2 mg/cm$^2$. Incidentally, since the toner is diffused by flaring, some unevenness in toner transfer to the toner supporting object 31 from the magnet sleeve 57 does not cause a problem, a device for superposing an AC bias onto the direct-current bias between the magnet sleeve 57 and the toner supporting object 31 is unnecessary, and a device for strictly homogenizing the ear of the 2-component developer is also unnecessary.

On the other hand, since the amount of the toner necessary for forming a solid image on the latent image supporting object (photo conductor) 58 is 0.4 mg/cm$^2$, it is necessary to make the moving speed of the toner supporting object 31 equal to or greater than twice the moving speed of the latent image supporting object (photo conductor) 58 so that a sufficient amount of the toner is provided to the development position. Accordingly, the moving speed of the toner supporting object 31 is made 2.5 times the latent image supporting object (photo conductor) 58 in this embodiment. A moving direction of the toner supporting object 31 may be the same as a moving direction of the latent image supporting object (photo conductor) 58 as shown in FIG. 11; nevertheless, the moving direction of one may be opposite to the other. It is preferred that the moving direction of the magnet sleeve 57 is reverse to the moving direction of the toner supporting object 31 as shown in FIG. 11 for enhancing residual toner scratching efficiency.

With the system described above, it was confirmed that high-definition development of a 1200 dpi dot was realized with satisfactory solid image nature without ground dirt at a linear speed of 300 mm/s of the latent image supporting object (photo conductor) 58.

Figure 12:
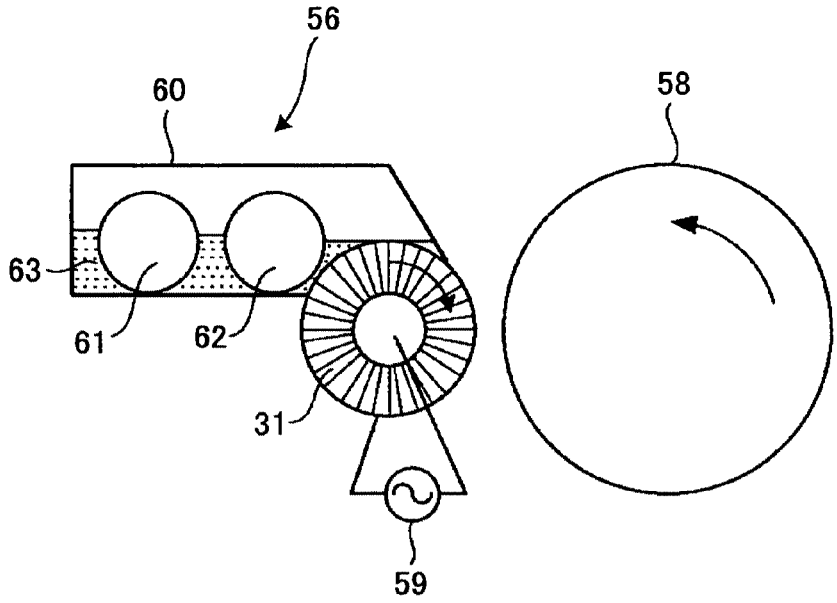
FIG. 12 is a schematic drawing showing another example of the image formation apparatus wherein development is carried out by hopping using the 2-component developer.

FIG. 12 shows the outline of another example of the image formation apparatus wherein the hopping method development using the 2-component developer is performed. According to this example, the magnet sleeve 57 provided to the image formation apparatus of FIG. 11 is dispensed with, and the toner is supplied to the toner supporting object 31 by a cascade development phenomenon of the 2-component developer. Because the thin toner layer is formed on the toner supporting object 31 by a simple cascade, a rate of toner transfer to the toner supporting object 31 is small compared with the embodiment shown in FIG. 11. However, by increasing the rotating speed of the part toner supporting object 31, the development speed of the latent image supporting object (photo conductor) 58 can be obtained. The development apparatus including the toner supporting object 31 and the 2-component development unit 56 without the magnet sleeve is essentially of the same size as the conventional 2-component development apparatus, that is, it is smaller than the apparatus shown in FIG. 11. Yet, the development apparatus shown in FIG. 12 is capable of forming a high-definition image like the development apparatus shown in FIG. 11.

Figure 13:
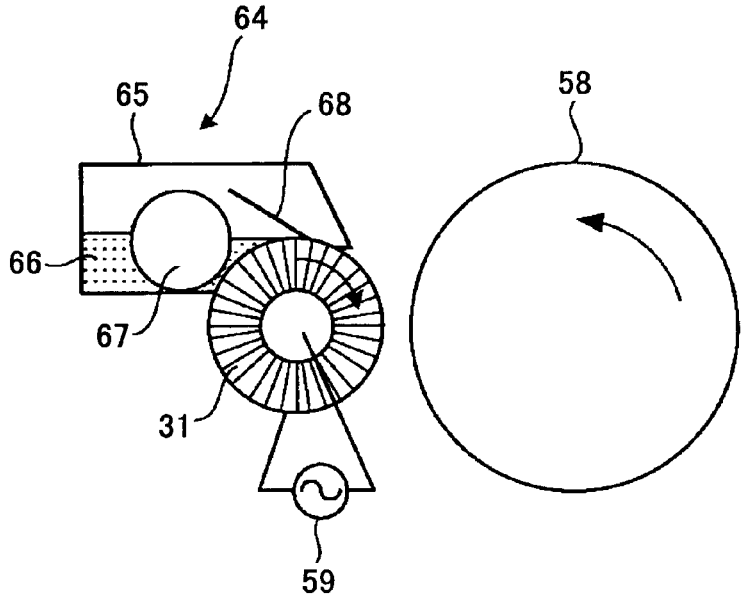
FIG. 13 is a schematic drawing showing an outline of an image formation apparatus according to the embodiment of the present invention.

FIG. 13 shows the outline of the image formation apparatus according to the embodiment of the present invention. The image formation apparatus differs from the image formation apparatuses shown in FIG. 11 and FIG. 12 in that a development unit 64 using a 1-component developer is used instead of the 2-component development unit 56 that uses the 2-component developer. Here, the 1-component developer consists only of a toner. According to the development unit 64, the toner is transferred to the toner supporting object 31, and a thin toner layer is formed on the toner supporting object 31. The development unit 64 supplies a toner 66 to the toner supporting object 31 while stirring and circulating the toner 66 in a container 65 by a circulation paddle 67. The toner supporting object 31, the surface of which is rotationally driven for an endless movement, supports the supplied toner 66 on its surface and conveys the toner to a contact position with a metering blade 68 that serves as a regulating member and is made of a flexible material.

The contact position serves as a toner thickness regulation position, at which the thickness of the toner layer on the toner supporting object 31 is regulated for a uniform thickness when the toner layer enters this position. In this way, the thickness of the thin toner layer on the surface of the toner supporting object 31 is regulated and made uniform.

The metering blade 68 is made of a flexible material such as a thin plate, a film, etc., that is not elastically deformed in a thickness direction. One end of the metering blade 68 is supported by a supporting member such as a bracket that is not illustrated, and the other end contacts the toner supporting object 31. According to this configuration, the whole area of the supported end of the metering blade 68 is supported by the supporting member in directions perpendicular to the movement of the surface of the toner supporting object 31 (that is, in directions penetrating the drawing paper). For this reason, bending at a central position can be reduced compared with a roller that can be supported only at both ends by the bearings. Further, since the metering blade 68 is made of the material that is not elastically deformed in the thickness direction, thickness unevenness of the toner due to the elastic deformation in the thickness direction is avoided. As described above, both thickness unevenness of the toner due to the elastic deformation in the thickness direction of the roller produced by a roller made of urethane foam and thickness unevenness of the toner due to bending in a direction of an axis of the roller are avoided. Accordingly, uneven development concentration due to the thickness unevenness of the toner on the surface of the toner supporting object 31 is reduced compared with the conventional practice.

The toner used by the image formation apparatus according to the embodiment is made of a base-material resin (the main material of the toner) that consists of polyester or styrene acrylics that has a negative regular electrification polarity. Further, both a latent image part and a uniformly charged part (background) of the latent image supporting object (photo conductor) 58 are made into the same polarity as the regular electrification polarity of the toner (that is, the negative polarity according to this example), and the toner is selectively adhered to the latent image part, a voltage of which is smaller than the background so that the so-called reversal development is performed.

The metering blade 68 serving as the regulating member is made of a material that promotes friction electrification on to the side of the regular electrification polarity of the toner (negative polarity according to this example) when the metering blade 68 is in sliding contact with the toner on the surface of the toner supporting object 31. That is, the toner is located at a more negative position on a friction electrification series than the metering blade 68. The metering blade 68 is made of a material that realizes the relationship described above, e.g., organic materials such as silicone, nylon, melamine resin, acrylic resin, PVA, and urethane. In addition, the fourth class ammonium salt, and a nigrosine system dye, etc., may be used. Further, a mixture of two or more of the materials listed above may be used.

According to the image formation apparatus that includes the metering blade 68, friction electrification onto the side of the regular electrification polarity of the toner is promoted by sliding contact with the toner on the surface of the toner supporting object 31. In this way, degradation of the image quality due to conveying a toner with poor electrification to the development position can be reduced.

Here, the toner supporting object 31 includes the protection layer 3 as shown in FIG. 1. The protection layer 3 is made of a material that promotes friction electrification on to the side of the regular electrification polarity of the toner when the protection layer 3 is in sliding contact with the toner that is hopping on the surface of the toner supporting object 31. With this configuration, electrification in polarity opposite to the regular electrification polarity of the toner due to the sliding contact with the protection layer 3 is avoided. In this way, a fall of an amount of electrification (regular electrification polarity) of the toner due to hopping on the surface of the toner supporting object 31 is reduced, and accordingly, poor development due to poor hopping of the toner can be reduced.

Alternatively, a toner that has a positive regular electrification polarity may be used. In this case, the metering blade 68 and the protection layer 3 are made of a material that promotes friction electrification by sliding contact with the toner on to the side of the positive polarity.

The electrification series of a toner is that of the toner as a whole including additives such as silica, and titanium oxide to the toner base-material resin (particles). A position in the electrification series of a toner may be determined as follows. That is, the toner on a surface-protection layer is in sliding contact with one of the metering blade 68 and the protection layer 3 for a predetermined time, then the toner is extracted by attraction, then an amount of electrification of the extracted toner is measured by an electro meter. If a measurement result shows an increase in the amount of electrification to the negative polarity of the toner, the toner is determined to have the more negative position in the electrification series than the metering blade 68 or the protection layer 3, as applicable. Further, if the measurement result shows an increase in the amount of electrification to the positive polarity of the toner, the toner is determined to have the more positive position in the electrification series than the metering blade 68 or the protection layer 3, as applicable.

Further, a middle layer may be provided between the protection layer 3 and the electrodes. The material of the middle layer may be, e.g., Ti, Sn, Fe, Cu. Cr, Ni, Zn, Mg, Al, $TiO_2$, $SnO_2$, $Fe_2O_3$, $Fe_3O_4$, CuO, $Cr_2O_3$, NiO, ZnO, MgO, and $Al_2O_3$.

Figure 8:
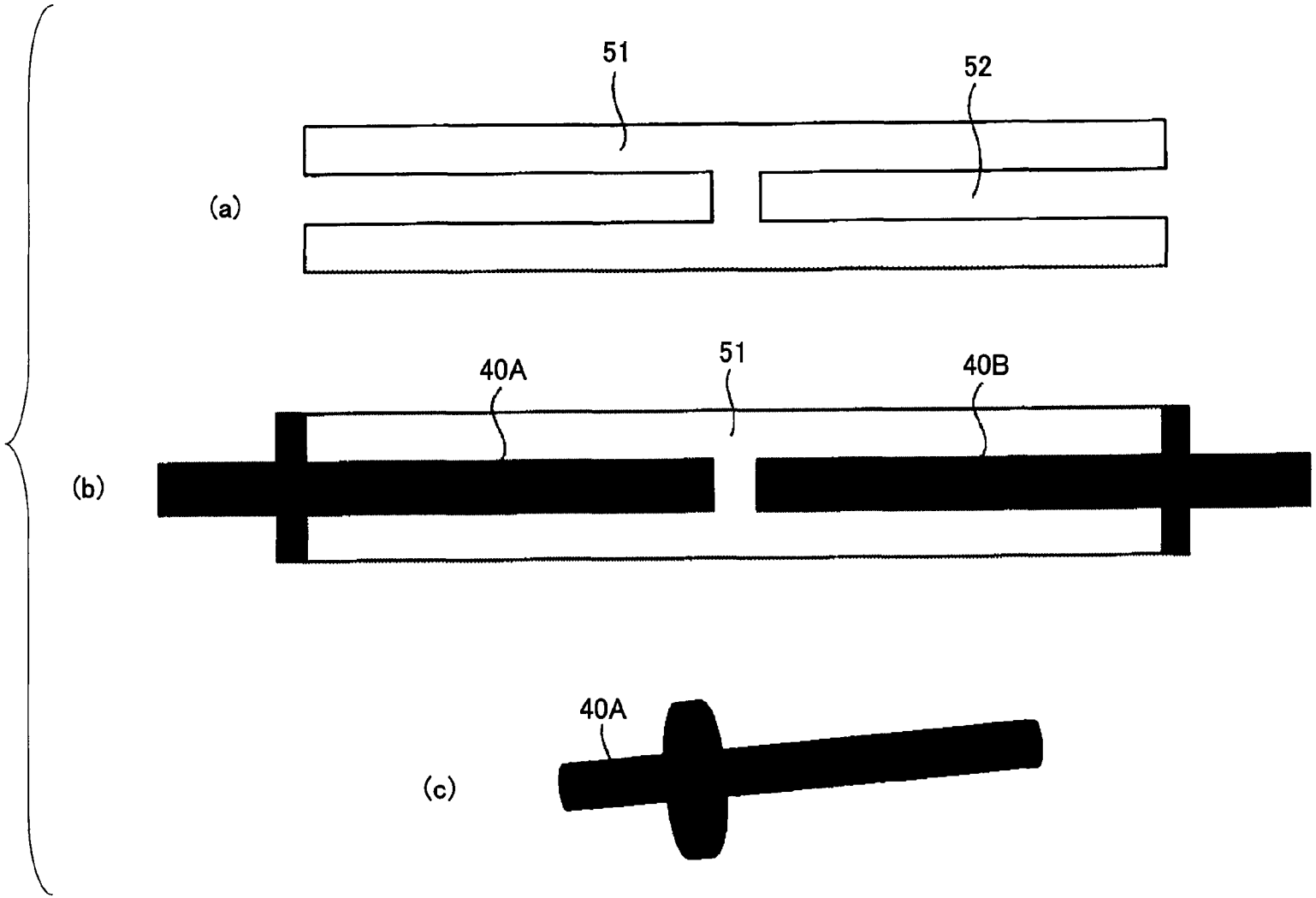
FIG. 8 is a cross-sectional drawing showing a part of a manufacturing process of the toner supporting object.

According to the image formation apparatus of the embodiment, two or more electrodes of the toner supporting object 31 are in sliding contact for one of the electrode shafts 40A and 40B irrespective of the rotational position of the toner supporting object 31 as shown in FIG. 7 and FIG. 8 at (b) such that the electric field for hopping may be formed all over the periphery of the surface of the toner supporting object 31 in the endless moving direction (rotational direction). With this configuration, the toner on the surface of the toner supporting object 31 continues hopping in a process from the toner thickness regulation position by the metering blade 68 until the toner reaches the development position, and the flare state of the toner is maintained.

The inventors hereto prepared a printer testing machine having the same configuration as the image formation apparatus according to the embodiment described above, except that the electrodes of the toner supporting object 31 contact one of the electrode shafts 40A and 40B only when the rotational position of the toner supporting object 31 is at a predetermined position. Experiments were conducted for three different predetermined positions as follows.

(1) Experiment number 1: the rotational position that counters the development position (2) Experiment number 2: the rotational position that counters the toner thickness regulation position, and the rotational position that counters the development position (3) Experiment number 3: all areas from the rotational position that counters the toner thickness regulation position to the rotational position that counters the development position In the experiments, a test image was printed with the printer testing machine, and evaluations were made about a distribution of toner electrification amounts, a convergence nature of toner electrification, and a presence of ground dirt. The distribution of the toner electrification amounts was evaluated as follows. That is, a printing operation (i.e., rotational drive of the toner supporting object 31) was halted during a test print, and the toner in an area just before the development position of the toner supporting object 31 was extracted. Then, with a commonly known technique, an amount of electrification of each toner particle in the extracted toner was measured, and the distribution of the electrification amounts was analyzed. Then, the distribution was classified into three categories, namely, great, medium, and small.

As for the convergence of the toner electrification amounts, an electrification range, which is equal to the standard deviation of the distribution of the electrification amounts, was analyzed. Then, the convergence was classified into three categories, namely, small, medium, and great that are expressed by ○, Δ, and X, respectively, in Table 1 that follows. Since the toner electrification was saturated at a certain level, the better was the convergence of the electrification amounts (i.e., the smaller is the electrification range that is equal to the standard deviation), the more sufficiently was the toner electrified.

Further, for evaluating the presence of ground dirt, during test printing, the testing machine was suspended, and an adhesive transparent tape was attached to the background of the latent image supporting object (photo conductor) 58 such that the toner adhering to the background was removed by and transferred to the adhesive transparent tape. Then, the amount of the toner transferred to the tape was classified into four categories; namely, ◎ (no toner transferred), ○ (although there is a slight transfer of the toner, it is not visible), Δ (the transferred toner is visible), and X (the transferred toner is conspicuous).

Experiment results are shown in the following Table 1.

TABLE 1

| Experiment # | Hopping formation at regulation position | Continuous hopping formation from regulation position to development position | Distribution of toner electrification amount | Convergence of toner electrification amount | Ground dirt |
|---|---|---|---|---|---|
| 1 | None | None | Great | X | X |
| 2 | Formed | None | Small | Δ | ○ |
| 3 | Formed | Formed | Small | ○ | ◎ |

As shown in Table 1, as for the experiment number 1, the distribution of the toner electrification amounts was relatively great (Great), and the convergence of the toner electrification amounts was relatively small (X). This indicated that a part of the toner conveyed to the development position was not fully electrified. For this reason, as shown in Table 1, the ground dirt was produced (X) by the toner with poor electrification. Concerning the experiment number 2, the distribution of toner electrification amounts, the convergence of toner electrification amounts, and the ground dirt were improved compared with the experiment number 1. However, since the convergence of toner electrification amounts was not enough, the toner was slightly adhered to the background of the latent image supporting object (photo conductor) 58. According to the experiment number 3, since the best results were obtained concerning the distribution of toner electrification amounts and the convergence of toner electrification amounts, no ground dirt was generated. From the experiment results, it was concluded that the electrification of the toner on the surface of the toner supporting object 31 was promoted by hopping between the regulation position and the development position, wherein the toner and the protection layer 3 of the toner supporting object 31 were in sliding contact, and the friction electrification was promoted.

As described above, the image formation apparatus according to the embodiment, the electric field for hopping is formed all over the periphery of the surface of the toner supporting object 31 in the endless moving direction, friction electrification of the toner is promoted between the regulation position and the development position; in this way, generation of the ground dirt by poor electrification of the toner is reduced.

Next, examples of the image formation apparatus are described, wherein one or more features are added to the image formation apparatus of the embodiment as described above. Unless specified, the configuration of the image formation apparatus in the following examples is the same as that of the embodiment.

[Embodiment 1]

The inventors hereto prepared two kinds of the metering blade 68 for the printer testing machine, one consisting of a non-conductive material, and the other consisting of a conductive material. Then, the test image is continuously printed for a predetermined number of sheets, and adhesion nature of the toner to the metering blade 68 is evaluated in three categories, namely, X (adhesion is visible at a glance), ○ (adhesion is slightly visible if an eye is well elaborated), and ◎ (adhesion is not visible at all). Results are shown in the following Table 2.

TABLE 2

| Experiment # | Formation of hopping electric field at regulation position | Conductivity of metering blade | Adhesion of toner to metering blade |
|---|---|---|---|
| 4 | None | Conductive | X |
| 5 | Formed | Non-conductive | ○ |
| 6 | Formed | Conductive | ◎ |

Comparing the experiment number 5 with the experiment number 6 of Table 2, it is concluded that the conductive blade gives the better result than the non-conductive blade regarding the toner adhesion. This is considered to be because the toner is adhered by electrostatic force due to a counter charge (the toner being electrified in a polarity reverse to the toner) generated by sliding contact of the non-conductive material and the toner, while the conductive material does not generate such counter charge. In addition, with reference to the experiment number 4, in spite of using the conductive material for the metering blade 68, the evaluation result of adhesion of the toner is X (poor). This is considered to be because the hopping electric field is not formed at the regulation position, which promotes the adhesion of the toner by not making the toner hop on the surface of the toner supporting object 31 at the regulation position. In other words, by forming the hopping electric field at the regulation position, static electricity force that removes the toner from the surface of the regulating member is periodically generated; and as a result, the toner adhesion to the regulating member is reduced.

In view of above, the image formation apparatus according to Embodiment 1, the metering blade 68 is made of a conductive material such that the toner adhesion to the metering blade 68 is reduced. In addition, as described in the embodiment, the hopping electric field is formed all over the periphery of the toner supporting object 31. Therefore, the toner adhesion to the metering blade 68 is reduced also by making the toner hopping at the regulation position.

[Embodiment 2 ]

Figure 14:
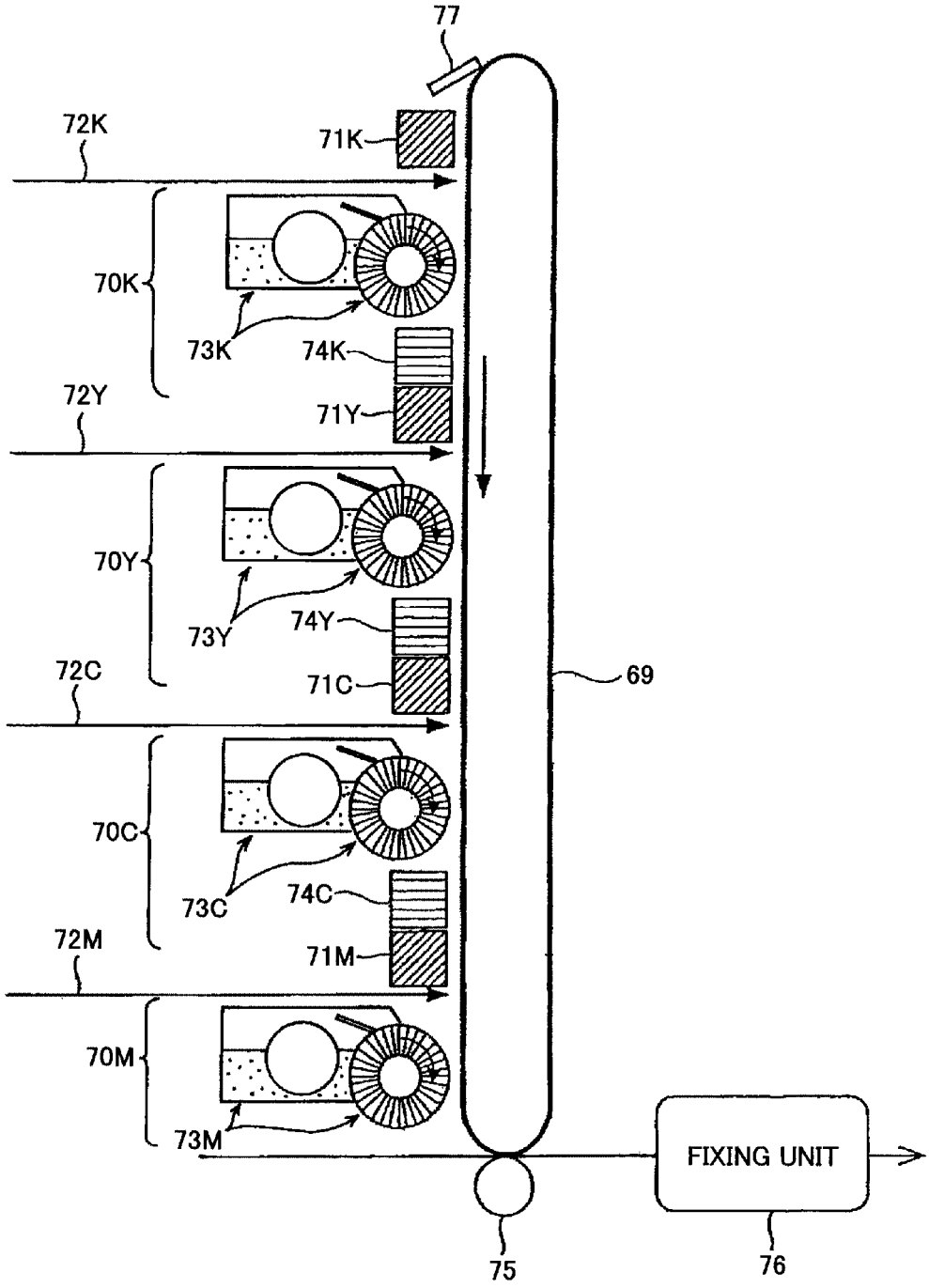
FIG. 14 is a schematic drawing showing the image formation apparatus according to Embodiment 2 of the present invention.

FIG. 14 shows the outline of the image formation apparatus according to Embodiment 2. This image formation apparatus includes development apparatuses 73K, 73Y, 73C, and 73M. Each of the development apparatuses includes a development unit that is the same as the development unit 64 as shown in FIG. 13, and a toner supporting object that is the same as the toner supporting object 31 as shown in FIG. 13.

The development apparatuses 73K, 73Y, 73C, and 73M are for developing latent images in predetermined colors with toners of the corresponding colors, wherein the toner images of the colors are superposed on a belt-like organic photo conductor 69. The belt-like organic photo conductor 69 is wound around two rollers that are not illustrated, and rotationally driven by a driving unit that is not illustrated.

The image formation apparatus of Embodiment 2 includes image formation units 70K, 70Y, 70C, and 70M for forming images in two or more colors, for example, black, yellow, cyan, and magenta, respectively, that are shown on the left-hand side of the organic photo conductor 69 in FIG. 14. The photo conductor 69 is uniformly charged by an electrification unit 71K, and exposed by an optical beam 72K modulated by image data for black color and provided by a writing unit (not illustrated) of the imaging formation unit 70K. In this way, an electrostatic latent image is formed. The electrostatic latent image is developed by the development apparatus 73K, which is configured the same as the development apparatus that includes the development unit 64 and the toner supporting object 31 shown in FIG. 13, and turns into a toner image in black. Then, electrification of the organic photo conductor 69 is removed by an electrification removing unit 74K; then the following image formation is processed.

Then, the organic photo conductor 69 is uniformly charged by an electrification unit 71Y, and exposed by an optical beam 72Y modulated by image data for yellow color and provided by a writing unit (not illustrated) of the image formation unit 70Y such that an electrostatic latent image is formed. The electrostatic latent image turns into a toner image in yellow, and the toner image is developed by the development apparatus 73Y, which is configured the same as the development apparatus including the development unit 64 and the toner supporting object 31 shown in FIG. 13. The toner image in yellow is superposed to the toner image in black. Then, the electrification of the organic photo conductor 69 is removed by an electrification removing unit 74Y, then, the following image formation is processed.

Next, the organic photo conductor 69 is uniformly charged by an electrification unit 71C, and is exposed by an optical beam 72C modulated by image data for cyan color and provided by a writing unit that is not illustrated of the image formation unit 70C such that an electrostatic latent image in cyan is formed. The electrostatic latent image turns into a toner image in cyan color, which is then developed by the development apparatus 73C having the same configuration as the development apparatus including the development unit 64 and the toner supporting object 31 shown in FIG. 13. The toner image in cyan is superposed to the toner image in black and the toner image in yellow. Then, the electrification of the organic photo conductor 69 is removed by an electrification removing unit 74C, then the following image formation is processed.

The organic photo conductor 69 is uniformly charged by an electrification unit 71M, and is exposed by an optical beam 72M modulated by image data for magenta color and provided by a writing unit (not illustrated) of the image formation unit 70M such that an electrostatic latent image in magenta is formed. The latent image is developed by the development apparatus 73M having the same configuration as the development apparatus including the development unit 64 and the toner supporting object 31 shown in FIG. 13. The toner image in magenta is superposed to the toner image in black, the toner image in yellow, and the toner image in cyan so that a full color image is formed.

On the other hand, a recording medium such as paper is provided by a feeding unit that is not illustrated, and the full color image on the photo conductor 69 is transferred to the recording medium by a transfer roller 75, to which a transfer bias is provided by a power source. The full color image on the recording medium is fixed by a fixing unit 76, and the recording medium is discharged outside. After full color image transfer, residual toner on the photo conductor 69 is removed by a cleaner 77.

According to the image formation apparatus, since the toner images in four colors are formed on the same organic photo conductor 69, compared with the usual 4-color tandem system, position gap hardly occurs theoretically, and a high-definition full color image can be acquired.

In addition, according to the image formation apparatus as described above, both conditions of Vmax V/p μm>1 and p μm<d μm are sufficed in view of the results of the experiments described above. That is, no influences are affected in the toner image formed on the organic photo conductor 69, and no toner is transferred from a foregoing toner image formed on the organic photo conductor 69 to the development apparatus of a next color. In this way, high quality images are stably formed for a long period without problems such as scavenging and color mixture.

Although the embodiments are described about the image formation apparatus wherein the toner is conveyed to the development position by the surface movement of the toner supporting object while the toner is flared and hopping between two adjacent electrodes, the present invention can be applied to an image formation apparatus wherein, a toner is conveyed to a development position of a toner supporting object by repeatedly hopping from a certain electrode upward to an adjacent electrode in a direction from one end to the other of the toner supporting object like the method disclosed by JPA 2002-341656. Further, the present invention is also applicable to an image formation apparatus wherein the toner is conveyed to the development position by both hopping the toner and by movement of the surface of the toner supporting object.

Further, the present invention is not limited to these embodiments, but variations and modifications may be made without departing from the scope of the present invention.

The present application is based on Japanese Priority Application No. 2006-279541 filed on Oct. 13, 2006 with the Japanese Patent Office, the entire contents of which are hereby incorporated by reference.

What is claimed is:

1. A development apparatus, comprising:

a toner supporting object to support and convey a toner by a movement of the toner supporting object, while the toner is hopping on a surface of the toner supporting object due to an electric field;

a regulating member to regulate a thickness of the toner on the toner supporting object, the regulating member comprised of a flexible material and supported at one end thereof, the other end of the regulating member contacting the toner support object; and a latent image supporting object to support a latent image, wherein the toner supporting object is moved to convey the toner on the surface thereof to a position opposite the latent image supporting object where the toner is attached to the latent image on the latent image supporting object, wherein the toner supporting object includes a plurality of slots formed in the surface thereof, each slot including an electrode formed therein, the toner supporting object further including a protection layer formed on the surface thereof, and wherein each of the protection layer and the flexible material of the regulating member includes a material that promotes frictional electrification of the toner to a regular electrification polarity as the protection layer based on slide contact of the flexible material with the toner on the surface of the toner supporting object.

2. The development apparatus as claimed in claim 1, wherein the surface of the toner supporting object is endlessly moved, and the electric field is formed all over the surface in a direction of the endless movement.

3. The development apparatus as claimed in claim 1, wherein the toner is mainly one of polyester and styrene acrylics, and the flexible material is one of silicone resin, nylon resin, melamine resin, acrylic resin, poly vinyl alcohol (PVA), urethane, quaternary ammonium salt, nigrosine system dye, and a combination of two or more thereof.

4. The development apparatus as claimed in claim 1, wherein the flexible material is a conductive material.

5. An image formation apparatus, comprising:

the development apparatus as claimed in claim 1;

wherein two or more toner images are superposed on the latent image supporting object by the development apparatus.

6. The development apparatus as claimed in claim 1, wherein the electrode formed in each of the plurality of slots, when taken together, comprise a plurality of electrodes, a first portion of the plurality of electrodes conduct a first voltage, and a second portion of the plurality of electrodes conduct a second voltage, wherein, when the first portion of the plurality of electrodes conduct the first voltage and the second portion of the plurality of electrodes conduct the second voltage, the electric field is created on the surface of the toner supporting object such that the toner is hopping on the surface.

7. The development apparatus as claimed in claim 6, wherein the first voltage is an AC voltage of a first phase, and the second voltage is an AC voltage of an inverse phase to the first phase.

8. The development apparatus as claimed in claim 6, wherein the first voltage is an AC voltage of a first phase, and the second voltage is a DC voltage equal to an average voltage of the AC voltage of the first phase.

9. The development apparatus as claimed in claim 6, wherein the electrode formed in each of the plurality of slots alternates from being one of the first portion of plurality of electrodes or one of the second portion of the plurality of electrodes, such that an alternating electrode pattern is created.

* * * * *